United States Patent [19]

Kubota et al.

[11] 4,294,632

[45] Oct. 13, 1981

[54] METHOD FOR OVERAGING OF HOT DIP METAL COATED STEEL MATERIAL

[75] Inventors: Michio Kubota; Kazuhiro Takagi, both of Amagasaki; Yorimasa Mitani, Osaka, all of Japan

[73] Assignee: Nisshin Steel Co., Ltd., Tokyo, Japan

[21] Appl. No.: 78,407

[22] Filed: Sep. 24, 1979

[51] Int. Cl.[3] ..... C21D 6/02; C21D 9/48

[52] U.S. Cl. ..... 148/142; 148/12.3; 148/154; 148/156

[58] Field of Search ..... 148/142, 156, 11.5 Q, 148/12.3, 154

[56] References Cited

U.S. PATENT DOCUMENTS 4,052,234 10/1977 Yamagishi et al. ..... 148/156

*Primary Examiner*—R. Dean

*Attorney, Agent, or Firm*—Kane, Dalsimer, Kane, Sullivan and Kurucz

[57] ABSTRACT

Method for overaging hot dip metal coated steel material to improve formability, comprising rapidly heating the material to a temperature of above 300° C. but below that at which the coating is undesirably denatured at heating rate of at least 50° C./sec., followed by controlled slow cooling of cooling rate of not more than 20° C./sec. Total processing time required can be one or two minutes, thus the method can be continuously carried out.

5 Claims, 5 Drawing Figures

METHOD FOR OVERAGING OF HOT DIP METAL COATED STEEL MATERIAL

BACKGROUND OF THE INVENTION

The present invention relates to a continuous method for the overaging of a hot dip metal coated steel sheet or strip material to improve the formability of the material, which is hard due to the presence of C and N in the form of supersaturated solid solution in the base steel.

Hot dip metal coated steel sheets and strips, including those coated with aluminum, zinc and zinc-iron alloy, are widely used for various applications in which advantageous properties of the respective materials are enjoyed. Among known processes for producing such coated steel materials, continuous coating processes involving an in-line anneal are said to be most advantageous from the view points of productivity and economy. The most typical one is known as Sendzimir process. As is known, such a continuous coating process is usually applied to the cold rolled steel sheet or strip which contains carbon up to 0.15% by weight and nitrogen up to 0.01% by weight.

In Sendzimir process, before a cold rolled steel strip is dipped in a molten coating metal bath, it is heated in a non-oxidizing or weakly oxidizing atmosphere to remove any organic materials, attached to the surfaces of the steel strip, including the rolling mill oil used in the cold rolled steps, and then subjected to a reduction in a reducing atmosphere in order to make the surfaces clean. Such heating steps for cleaning the surfaces of the steel strip can be utilized for annealing. In other words, the surface cleaning steps of Sendzimir process can be substituted for the final annealing steps of the cold rolled steel strip making process. For this reason Sendzimir process is very economical and reasonable. However, the coated steel products obtained by Sendzimir process is very hard and poor in the formability. This is because the hot coated steel product which has left the molten metal bath is continuously rapidly quenched. As is well known in the art, those contents of C and N, which have been present in the hot coated steel product in the state of being dissolved in the base steel, are not allowed to sufficiently precipitate upon rapid quenching so that they remain in the quenched product in the form of supersaturated solid solution, rendering the product hard and poor in the formability.

In order to precipitate such supersaturating C and N thereby to improve the formability of the coated steel products, overaging methods are effective, as proposed in examined Japanese Patent Publication Nos. 43-12968 and 46-10922, published on June 1, 1968 and on Mar. 19, 1971, respectively. In these methods, the coated steel sheet or strip material is wound up in the form of coil, and then subjected to a low temperature box anneal for a prolonged period of time at a temperature ranging between 204° and 454° C. Such time consuming batchwise methods are not convenient for a large scale continuous production.

SUMMARY OF THE INVENTION

Accordingly, an object of the invention is to provide a continuous method for the overaging of a hot dip metal coated steel sheet or strip material to improve the formability thereof, which is capable of processing the material with a productivity much higher than those attainable by the known overaging methods. In other words, the object of the invention is the provision of a novel continuous method for the overaging of a hot dip metal coated steel sheet or strip material to improve the formability thereof, in which a continuous web of the material is processed while being caused to run in a production line.

In accordance with the invention a continuous method for the overaging of a hot dip metal coated steel sheet or strip material to improve the formability of the material, which is hard due to the presence of C and N in the form of supersaturated solid solution, comprises the steps of continuously passing the material through a heating zone so as to rapidly heat the material at a rate of heating of at least 50° C./sec. to a temperature above 300° C. but below that at which alloying of the coating with the base steel or formation of additional alloys not already present in the coated material will substantially take place, and continuously passing the heated material through a cooling zone so as to cool the material at a controlled rate of cooling of not more than 20° C./sec. until the supersaturation of C and N in the base steel substantially disappears.

BRIEF EXPLANATION OF THE DRAWINGS

The invention will now be described with reference to the attached drawings, in which.

DETAILED EXPLANATION OF THE INVENTION

Figure 1:
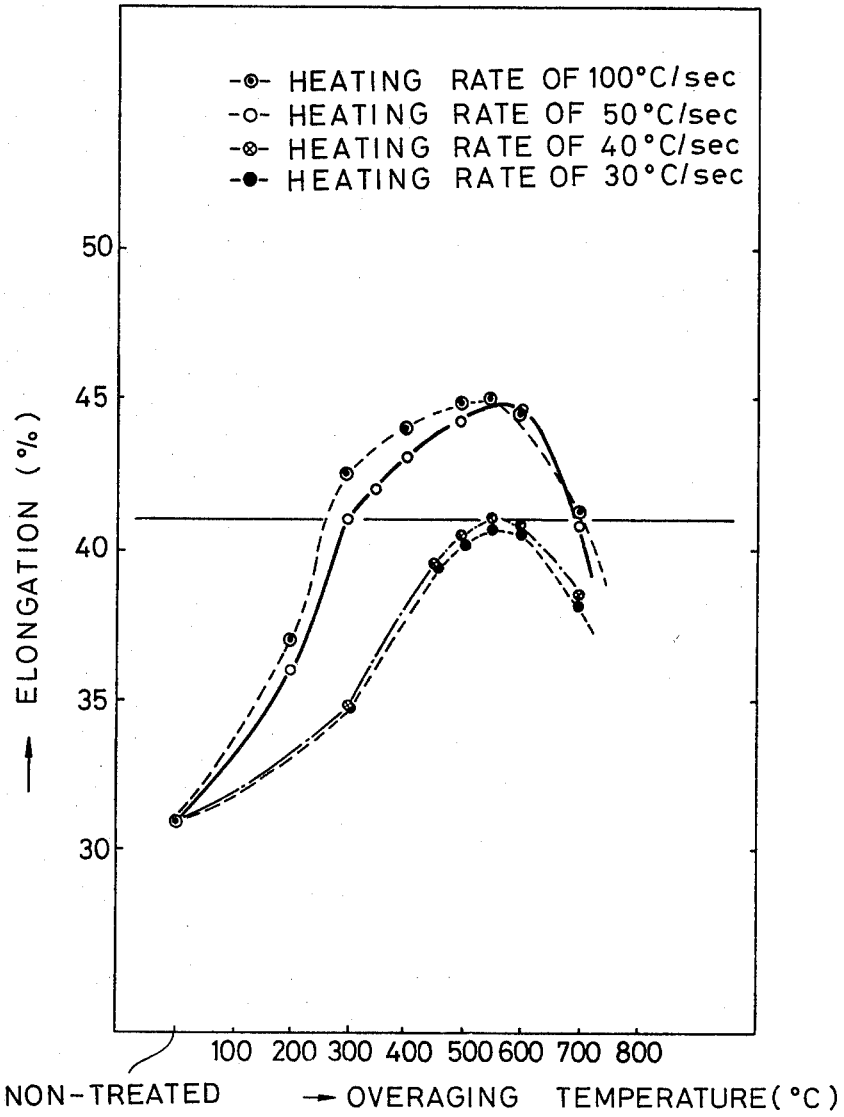
FIG. 1 is a graph illustrating effects of the rate of heating and the temperature of heating upon the elongation of the aluminum coated steel sheet material.

The experiments the results of which are shown in FIG. 1 were carried out on samples obtained by applying 60 g/m$^2$ of aluminum coatings on both sides of a cold rolled steel strip (0.8 mm in thickness) of the type as described in Example 1, followed by compulsive cooling. The samples exhibited an elongation of 31.2%. Using a selected rate of heating (30°, 40°, 50° or 100° C./sec.) the samples were heated to various temperatures and then immediately, that is with no retention time, subjected to a controlled cooling of 5° C./sec. to ambient temperature. After being subjected to a conditioning rolling of about 1.0%, the samples were tested for the elongation (%). For each selected rate of heating, the elongation was plotted against the temperature of heating. Curves so obtained are shown in FIG. 1. Another identical coated sample was subjected to a conventional low temperature box anneal, wherein the sample was heated to a temperature of 330° C. at a rate of heating of 50° C./hour in a Bell-type furnace, maintained at that temperature for a period of 16 hours and allowed to cool to ambient temperature in the furnace. The sample so treated exhibited an elongation of 41.9%. This level of elongation is also shown in FIG. 1. FIG. 1 reveals that it is critical for the purpose of the invention that the coated steel sheet should be heated to a temperature of about 300° C. or higher at a rate of heating of at least 50° C./sec.

Figure 2:
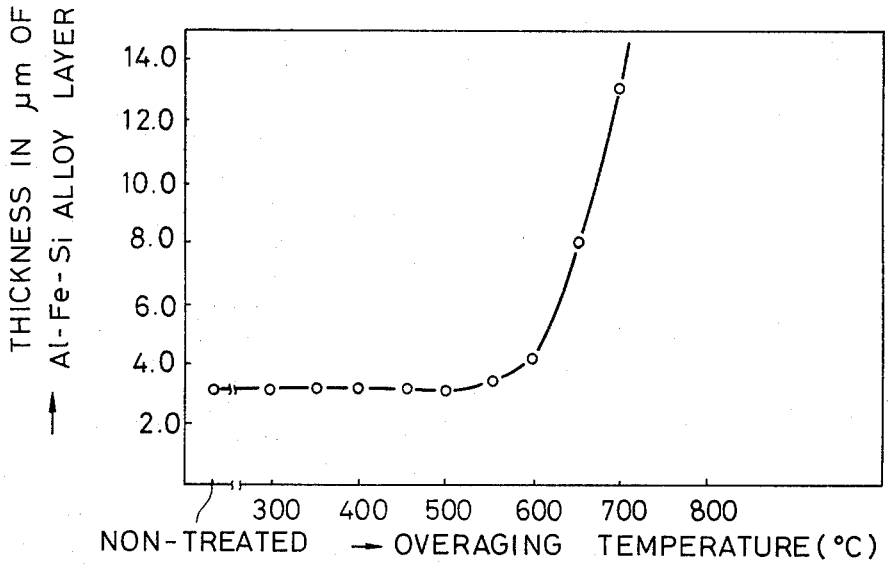
FIG. 2 is a graph illustrating effects of the temperature of heating up the thickness of the alloy layer in the aluminum coated steel sheet material.

In another series of experiments identical aluminum coated steel sheet samples were heated to various temperatures at a rate of heating of 80° C./sec., and then immediately allowed to start to cool at a controlled rate of cooling of 5° C./sec. to ambient temperature. The thickness in μm of the Al-Fe-Si alloy layer was plotted against the temperature of heating, whereby the graph shown in FIG. 2 was obtained. FIG. 2 reveals that if the coated aluminum steel sheet is heated to a temperature of higher than about 600° C., additional alloys not already present on the coated material are formed.

Figure 3:
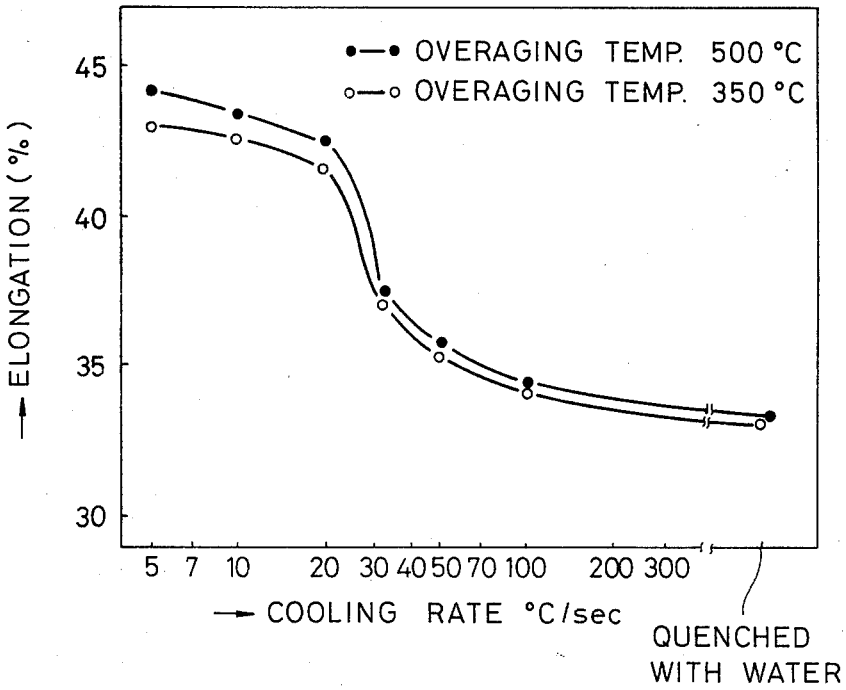
FIG. 3 is a graph illustrating effects of the rate of cooling upon the elongation of the aluminum coated steel material.

In a still other series of experiments identical samples were heated to a temperature of 500° C. or 350° C. at a rate of heating of 80° C./sec., and then immediately allowed to start to cool at various rates of cooling to ambient temperature. After being subjected a conditioning rolling of about 1.0%, the samples were tested for the elongation (%). For each overaging temperature used the elongation was plotted against the rate of cooling. Curves so obtained are shown in FIG. 3. The results, obtained when the heated samples were quenched with cold water, are also shown in FIG. 3. FIG. 3 reveals that for the purpose of the invention a rate of cooling of not more than about 20° C./sec. is critical.

While we do not intend to limit the invention by any operational mechanism, it is believed that a heat shock caused by the rapid heating introduces into the base steel structure dislocations which serve nuclei where the dissolved C and N may precipitate. The higher the rate of heating, the more effective heat shock would be caused. We have found, however, that while rapid heating of at least 50° C./sec. is critical, as the heating rate exceeds about 100° C./sec. the effect of rapid heating appears to become saturated. We prefer to use a heating rate of 70° C./sec. to 150° C./sec.

The temperature of heating, which is herein often referred to as the overaging temperature, must be above about 300° C., or otherwise the diffusion velocities of the dissolved C and N would be too low to ensure effective diffusion of these elements to the dislocation for the desired precipitation.

FIG. 3 reveals that the sample, which has been rapidly heated to a temperature of 350° C. and then rapidly quenched with water, exhibits an elongation as low as that of the non-treated sample. On the other hand, as is well known in the art, for example, from A. F. MOHRI: Iron and Steel Engineer, 7 (1956) 151, FIG. 6, that the solubility of carbon in steel at a temperature of 350° C. does not significantly differ from that at ambient temperature and, thus, the quenched aging effect is not brought about upon quenching from 350° C. Accordingly, it is believed that in the sample as rapidly heated to a temperature of 350° C. the effective precipitation of C and N (the desired overaging effect) does not yet take place. In other words, it is believed that the overaging effect takes place during the course of slow cooling, and the slower the rate of cooling the more effective the precipitation of C and N. While the rate of cooling of not more than 20° C./sec. has been found critical, we prefer to cool the material from the overaging temperature at a rate of cooling not more than 10° C./sec. Once the desired precipitation of C and N has taken place by the controlled slow cooling, it is advantageous to rapidly quench the cooled material to ambient temperature so as to shorten the production line.

Figure 4:
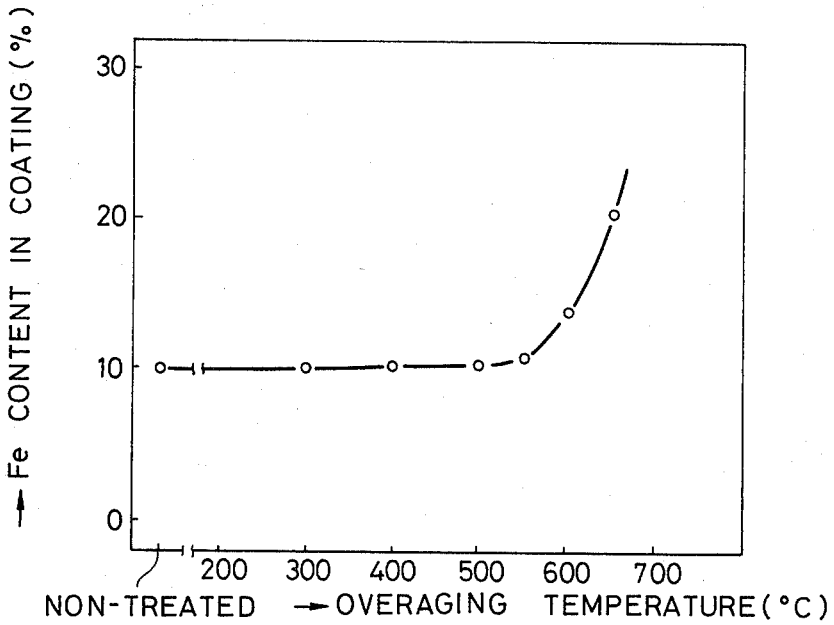
FIG. 4 is a graph illustrating effects of the temperature of heating upon the Fe content (% by weight) in the coating of the zinc-iron alloy coated steel sheet material; and, FIG. 5 is a graph illustrating effects of the temperature of heating upon the Fe content (% by weight) in the coating of the zinc coated steel sheet material.

A further series of experiments were carried on samples obtained by applying 45 g/m$^2$ of zinc-iron alloy coatings on both sides of a cold drawn steel strip of the type as described in Example 2 having a thickness of 0.8 mm. The samples were heated to various temperatures at a rate of heating of 80° C./sec., and then immediately allowed to start to cool at a rate of cooling of 5° C./sec. to ambient temperature. The Fe content in the coating in % by weight was analyzed and plotted against the overaging temperature. The results are shown in FIG. 4. It is revealed from FIG. 4 that if the overaging temperature exceeds about 550° C., alloying of the coating with the base steel substantially takes place.

Figure 5:
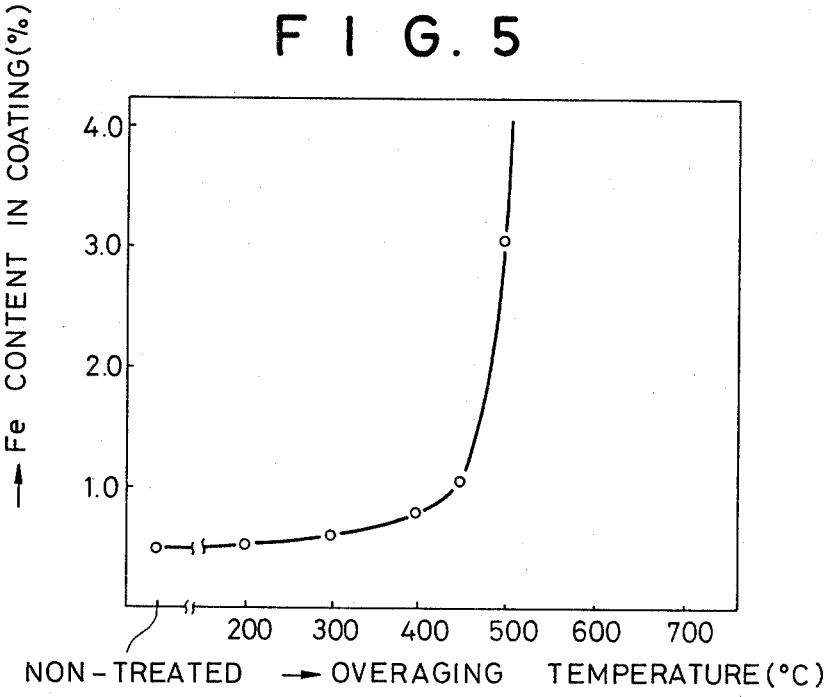

A still further series of experiments were carried out on samples obtained by applying 60 g/m$^2$ of zinc coatings on both sides of a cold drawn steel strip of the type as described in Example 3 having a thickness of 0.8 mm. The samples were heated to various temperatures at a rate of heating of 80° C./sec., and then immediately allowed to start to cool at a rate of cooling of 5° C./sec. to ambient temperature. The Fe content in the coating in % by weight was analyzed and plotted against the overaging temperature. The results are shown in FIG. 5. It is revealed from FIG. 5 that alloying of the coating with the base steel substantially takes place as the overaging temperature exceeds about 450° C. In order for the nature of the coating not to be denatured, the overaging temperature should be below that at which alloying of the coating with the base steel or formation of additional alloys not already present in the coated material will substantially take place. Such an upper limit of the overaging temperature primarily depends on the nature of the coating. When the coated steel material has been rapidly heated to an overaging temperature, it may be maintained at that temperature for a short period of time of up to 10 sec. In general the material rapidly heated to a predetermined overaging temperature should preferably be immediately subjected to the controlled cooling so as to avoid an unnecessary extension of the production line.

For the purpose of rapidly heating the running web of the coated steel sheet or strip material at a rate of heating of at least 50° C./sec. and up to 150° C./sec. or more, it is convenient to employ a high frequency induction heating technique. According to this technique, a high frequency AC current is caused to pass through coils surrounding but not in contact with the material to be heated so as to create an induced current in the material, whereby the material is internally heated by the Joule heat of the induced current. By such a technique, the required rapid heating can be conveniently carried out with a good controllability and efficiency.

The invention will be further described by the following Examples.

EXAMPLE 1

A rimmed steel prepared in a 90 ton converter and containing C 0.07%, Si 0.01%, Mn 0.30%, P 0.015%, N 0.0030% and S 0.016%, was subjected to a conventional hot rolling and cold rolling steps to provide a steel strip material having a thickness of 0.8 mm. The strip was passed through a conventional hot dip aluminum coating apparatus of Sendzimir type under conventional conditions to provide an aluminum coated steel sheet material having 60 g/m$^2$ of the coatings. The aluminum coated steel sheet material so prepared was used as samples. The samples were rapidly heated to the temperatures as indicated in Table 1 below at the heating rates indicated in the same table using a high frequency induction heating apparatus (with a frequency of 10 kHz), and then allowed to cool at the indicated cooling rates to ambient temperature. After being subjected to a conditioning rolling of about 1.0%, the samples were tested for various properties. The treating conditions and results are shown in Table 1. Table 1 further shows the results obtained by subjecting another identical sample to a conventional low temperature box anneal.

Table 1 reveals that Runs 1, 2 and 3, which are in accordance with the invention and require the total processing time of less than 71 sec., less than 92 sec., and less than 112 sec., respectively, achieve the results comparable with or even superior to those obtained in Run 8, which is conventional method and requires the total processing time of more than 22 hours.

TABLE 1

| Run No. | Conditions of overaging: Heating rate | Temperature | Retention time | Cooling rate | Mechanical properties: YP (Kg/mm²) | TS (Kg/mm²) | El (%) | Thickness of alloy layer (μ) | Remarks |
|---|---|---|---|---|---|---|---|---|---|
| 1 | 70° C./sec. | 350° C. | 0 sec. | 5° C./sec. | 25.0 | 35.8 | 42.5 | 3.3 | according to the invention |
| 2 | 80° C./sec. | 450° C. | 0 | 5° C./sec. | 24.1 | 35.0 | 44.0 | 3.2 | according to the invention |
| 3 | 100° C./sec. | 550° C. | 0 | 5° C./sec. | 23.8 | 34.2 | 45.0 | 3.4 | according to the invention |
| 4 | 20° C./sec. | 400° C. | 0 | 5° C./sec. | 27.0 | 38.0 | 38.0 | 3.3 | Heating rate is too low |
| 5 | 60° C./sec. | 650° C. | 0 | 5° C./sec. | 25.1 | 35.9 | 42.0 | 8.0 | Temperature is too high |
| 6 | 60° C./sec. | 200° C. | 0 | 5° C./sec. | 28.0 | 39.0 | 36.2 | 3.2 | Temperature is too low |
| 7 | 90° C./sec. | 500° C. | 0 | 50° C./sec. | 28.5 | 39.8 | 36.0 | 3.0 | Cooling rate is too high |
| 8 | 50° C./hr | 330° C. | 16 hr | cooled in furnace | 25.0 | 36.0 | 41.9 | 3.2 | Low temp. box anneal |

Note:
Mechanical properties are those in the direction of rolling
YP: Yield point
TS: Tensile strength
El: Elongation

EXAMPLE 2

A rimmed steel prepared in a 90 ton converter and containing C 0.05%, Si 0.01%, Mn 0.32%, P 0.015%, N 0.0032% and S 0.018%, was subjected to a conventional hot rolling and cold rolling steps to provide a steel strip material having a thickness of 0.8 mm. The strip was passed through a conventional hot dip zinc coating apparatus of Sendzimir type under conventional conditions to provide a zinc coated steel sheet material having 45 g/m² of the coatings, which was then subjected to an alloying treatment in the same production line and then quenched. The zinc-iron alloy coated steel sheet material so prepared was used as samples. The samples were rapidly heated to the temperatures as indicated in Table 2 below at the heating rates indicated in the same table using a high frequency induction heating apparatus (with a frequency of 10 kHz), and then allowed to cool at the indicated cooling rates to ambient temperature. After being subjected to a conditioning rolling of about 1.0%, the samples were tested for various properties. The treating conditions and results are shown in Table 2. Table 2 further shows the results obtained by subjecting another identical sample to a conventional low temperature box anneal.

Table 2 reveals that Runs 1, 2 and 3, which are in accordance with the invention and require the total processing time of 74 sec., less than 81 sec., and less than 104 sec., respectively, achieve the results comparable with or even superior to those obtained in Run 8, which is the conventional method and requires the total processing time of more than 21 hours.

TABLE 2

| Run No. | Conditions of overaging: Heating rate | Temperature | Retention time | Cooling rate | Mechanical properties: YP (Kg/mm²) | TS (Kg/mm²) | El (%) | Fe content in alloy layer (%) | Remarks |
|---|---|---|---|---|---|---|---|---|---|
| 1 | 70° C./sec. | 300° C. | 0 sec. | 4° C./sec. | 22.5 | 32.9 | 43.0 | 10.1 | according to the invention |
| 2 | 85° C./sec. | 400° C. | 0 | 5° C./sec. | 20.2 | 31.8 | 44.3 | 10.2 | according to the invention |
| 3 | 90° C./ | 500° C. | 0 | 5° C./ | 20.1 | 31.7 | 44.7 | 10.3 | according |

TABLE 2-continued

| Run No. | Conditions of overaging: Heating rate | Temperature | Retention time | Cooling rate | Mechanical properties: YP (Kg/mm²) | TS (Kg/mm²) | El (%) | Fe content in alloy layer (%) | Remarks |
|---|---|---|---|---|---|---|---|---|---|
| | sec. | | | sec. | | | | | to the invention |
| 4 | 15° C./sec. | 400° C. | 0 | 5° C./sec. | 25.6 | 36.0 | 39.0 | 10.2 | Heating rate is to low |
| 5 | 100° C./sec. | 650° C. | 0 | 5° C./sec. | 24.0 | 34.0 | 41.0 | 20.5 | Temp. is too high |
| 6 | 60° C./sec. | 200° C. | 0 | 5° C./sec. | 28.5 | 37.8 | 37.7 | 10.1 | Temp. is too low |
| 7 | 90° C./sec. | 500° C. | 0 | 50° C./sec. | 29.3 | 38.5 | 37.0 | 10.3 | Cooling rate is too high |
| 8 | 50° C./hr | 280° C. | 16 hr | cooled in furnace | 21.1 | 32.0 | 44.0 | 10.2 | Low temp. box anneal |

Note:
Mechanical properties are those in the direction of rolling
YP: Yield point
TS: Tensile strength
El: Elongation

EXAMPLE 3

A rimmed steel strip material of the same type as used in Example 2 was passed through a conventional hot dip zinc coating apparatus of Sendzimir type under conventional conditions to provide a zinc coated steel sheet material having 305 g/m² of the coatings. The zinc coated steel sheet material so prepared was used as samples.

The samples were rapidly heated to the temperatures as indicated in Table 3 below at the heating rates indicated in the same table using a high frequency induction heating apparatus (with a frequency of 10 kHz), and then allowed to cool at the indicated cooling rates to ambient temperature. After being subjected to a conditioning rolling of about 1.0%, the samples were tested for various properties. The treating conditions and results are shown in Table 3. Table 3 further shows the results obtained by subjecting another identical sample to a conventional low temperature box anneal.

Table 3 reveals that Runs 1, 2 and 3, which are in accordance with the invention and require the total processing time of 60 sec., less than 71 sec., and less than 81 sec., respectively, achieve the results comparable with or even superior to those obtained in Run 8, which is a conventional method and requires the total processing time of more than 21 hours.

TABLE 3

| Run No. | Conditions of overaging: Heating rate | Temperature | Retention time | Cooling rate | Mechanical properties: YP (Kg/mm²) | TS (Kg/mm²) | El (%) | Fe content in alloy layer (%) | Remarks |
|---|---|---|---|---|---|---|---|---|---|
| 1 | 70° C./sec. | 300° C. | 0 sec. | 5° C./sec. | 22.0 | 32.8 | 43.1 | 0.6 | according to the invention |
| 2 | 80° C./sec. | 350° C. | 0 | 5° C./sec. | 20.1 | 31.6 | 44.5 | 0.7 | according to the invention |
| 3 | 95° C./sec. | 400° C. | 0 | 5° C./sec. | 20.0 | 31.5 | 44.8 | 0.76 | according to the invention |
| 4 | 15° C./sec. | 300° C. | 0 | 5° C./sec. | 25.5 | 36.0 | 39.2 | 0.6 | Heating rate is too low |
| 5 | 100° C./sec. | 550° C. | 0 | 5° C./sec. | 25.0 | 35.5 | 40.5 | 14.0 | Temp. is too high |
| 6 | 65° C./sec. | 200° C. | 0 | 5° C./sec. | 26.0 | 36.5 | 39.0 | 0.51 | Temp. is too low |
| 7 | 90° C./sec. | 400° C. | 0 | 50° C./sec. | 28.1 | 38.0 | 38.0 | 0.76 | Cooling rate is too high |
| 8 | 50° C./hr | 280° C. | 16 hr | cooled in | 21.0 | 32.0 | 44.4 | 0.51 | Low temp. box |

TABLE 3-continued

| Run No. | Conditions of overaging: Heating rate | Temperature | Retention time | Cooling rate | Mechanical properties: YP (Kg/mm²) | TS (Kg/mm²) | El (%) | Fe content in alloy layer (%) | Remarks |
|---|---|---|---|---|---|---|---|---|---|
| | | | | furnace | | | | | anneal |

Note:
Mechanical properties are those in the sane direction of rolling
YP: Yield point
TS: Tensile strength
El: Elongation

What is claimed is:

1. A continuous method for the overaging of a hot dip metal coated steel sheet material to improve the formability of the material, which is hard due to the presence of C and N in the form of supersaturated solid solution, said method comprising the steps of continuously passing the material through a heating zone so as to rapidly heat the material at a rate of heating of at least 50° C./sec. to a temperature above 300° C. but below that at which alloying of the coating with the base steel or formation of additional alloys not already present in the coated material will substantially take place, and continuously passing the heated material through a cooling zone so as to cool the material at a controlled rate of cooling of not more than 20° C./sec. until the supersaturation of C and N in the base steel substantially disappears.

2. The method in accordance with claim 1 wherein said material is an aluminum coated steel sheet material and is rapidly heated to a temperature of 300° C. to 600° C.

3. The method in accordance with claim 1 wherein said material is a zinc-iron alloy coated steel sheet material and is rapidly heated to a temperature of 300° C. to 550° C.

4. The method in accordance with claim 1 wherein said material is a zinc-coated steel sheet material and is rapidly heated to a temperature of 300° C. to 450° C.

5. The method in accordance with any one of the preceding claims wherein said material is internally heated by a high frequency induction technique.

* * * * *